US006220209B1

(12) United States Patent
Nagaosa et al.

(10) Patent No.: US 6,220,209 B1
(45) Date of Patent: Apr. 24, 2001

(54) ROCKING FOLLOWER MECHANISM FOR THREE-DIMENSIONAL CAM

(75) Inventors: Hideo Nagaosa, Nishikamo-gun; Yoshihito Moriya, Nagoya; Shinichiro Kikuoka, Nishikamo-gun; Shuuji Nakano, Nagoya, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/351,284

(22) Filed: Jul. 12, 1999

(30) Foreign Application Priority Data

Aug. 20, 1998 (JP) ..... 10-234233

(51) Int. Cl.[7] ..... F04B 23/08
(52) U.S. Cl. ..... 123/90.1
(58) Field of Search ..... 123/90.18, 90.5, 123/90.15, 90.17, 90.48

(56) References Cited

U.S. PATENT DOCUMENTS 5,803,033 * 9/1998 Naruoka ..... 123/90.18
5,806,477 * 9/1998 Regueiro ..... 123/90.22
5,832,889 * 11/1998 Naruoka et al. ..... 123/90.18
5,988,127 * 11/1999 Hasegawa et al. ..... 123/90.18

* cited by examiner

*Primary Examiner*—Teresa Walberg
*Assistant Examiner*—Vinod D. Patel
(74) *Attorney, Agent, or Firm*—Oliff & Berridge, PLC

(57) ABSTRACT

A rocking follower mechanism for a three-dimensional cam is provided. The rocking follower mechanism prevents a hit sound without generating excessive abrasion on a cam follower or a cam surface of the three-dimensional cam, while providing a wide portion for the cam follower. The cam follower is restricted from moving in the axial direction. The wide portion of the cam follower is formed at a position so as not to be brought into contact with the cam surface of the intake cam. As a result, collision of the cam surface against an angular portion defined by a thrust surface and an end surface of the wide portion, i.e., direct abutment against the end surface, can be avoided. Therefore, it is possible to prevent the hit sound without generating excessive abrasion on the cam surface of the intake cam or the cam follower itself. Accordingly, excellent riding comfort of the vehicle can be maintained.

10 Claims, 10 Drawing Sheets

ROCKING FOLLOWER MECHANISM FOR THREE-DIMENSIONAL CAM

The disclosure of Japanese Patent Application No. Hei. 10-234233 filed on Aug. 20, 1998 including the specification, drawings and abstract is incorporated herein by reference in its entirety.

BACKGROUND OF THE INVENTION

1. Field of Invention

The present invention relates to a rocking follower mechanism for a three-dimensional cam. In particular, the invention relates to a rocking follower mechanism for a three dimensional cam for transmitting a positional variation of a cam surface of a three-dimensional cam to a valve lifter, in response to revolutions of an internal combustion engine.

2. Description of Related Art

There is a known variable valve timing mechanism capable of varying the on-off timing of an intake valve or an exhaust valve of an internal combustion engine. This is performed in accordance with operation of an internal combustion engine. In one of such variable valve timing mechanisms, there is a known mechanism as shown in FIG. 10. A lift amount of a valve 103 is varied using a three-dimensional cam 102 movable in the rotational axial direction so as to adjust the on-off timing of the valve, as disclosed in Japanese Patent Application Laid-open No. Hei 10-196333, for example.

In such a variable valve timing mechanism using a three-dimensional cam, a tilt angle of a cam surface 102*a* varies with the rotation. Also, a guide groove 105, extending in parallel with the rotational direction of the three-dimensional cam 102, is formed in the top surface 104*a* of a valve lifter 104. A semi-columnar follower 106 is capable of rocking in accordance with variation in the tilt angle of the cam surface 102*a*. The follower 106 is disposed in the guide groove 105 such that the three-dimensional cam 102 is sufficiently brought into contact with the valve lifter 104. This results in enhanced durability.

Further, in such a structure, the cam surface 102*a* of the three dimensional cam 102 slides on a cam sliding surface of the semi-columnar follower 106 in the axial direction thereof. Therefore, as shown in FIG. 10, the semi-columnar follower 106 has a wide portion 106*b* formed at its center. The guide groove 105 also has a wide groove 105*a* formed therein into which the wide portion 106*b* is inserted. The above described structure may allow a thrust surface 106*c* of the wide portion 106*b* to abut against a thrust surface 105*b* of the expanded- width groove 105*a*. As a result, the axial movement of the follower 106 is suppressed against the sliding movement of the cam surface 102*a*.

However, the wide portion 106*b*, formed in the center of the follower 106, is required to have a cam sliding surface 106*d*. The cam sliding surface 106*d* radially extends from the cam sliding surface 106*a* of the follower 106, on which the three-dimensional cam 102 slides.

The cam surface 102*a* of the three-dimensional cam 102 varies its position in contact with the cam sliding surface 106*a*, of the follower 106, by moving along a shaft 107 axially. As a result, the lift amount of the valve 103 is varied. Therefore, a width Cw of the cam surface 102*a*, in the axial direction, is greater than a width Fw of the cam sliding surface 106*a* of the follower 106.

Further, the sliding position between the cam surface 102*a*, of the three-dimensional cam 102, and the sliding surface 106*a*, of the follower 106, always varies in the axial direction of the follower 106 (in the direction of the arrow Z in FIG. 10). This variance is in response to the rotation of the three-dimensional cam 102.

Therefore, the cam surface 102*a*, of the three dimensional cam 102, slides so as to move along a portion defined by the cam sliding surface 106*a*, that is not adjacent to the cam sliding surface 106*d* of the wide portion 106*b*, and the cam sliding surface 106*a*, which is adjacent to the cam sliding surface 106*d*. If the sliding position is moved, the cam surface 102*a* of the three-dimensional cam 102 collides against an angular portion 106*e*. The angular portion 106*e* is defined by the thrust surface 106*c* and the cam sliding surface 106*d* of the wide portion 106*b*.

The aforementioned collision is likely to generate a hit sound. As may be appreciated, this sound is not preferable in view of driving environment of a motor vehicle, for example. Further, the collision may cause abrasion on the cam surface 102*a*, of the three-dimensional cam 102, as well as the cam sliding surface 106*d* of the wide portion 106*b*. This abrasion is heavy in comparison with the abrasion caused by the normal sliding movement. Accordingly, such abrasion resulting from the collision is not preferable in view of the durability of the variable valve timing mechanism.

SUMMARY OF THE INVENTION

Accordingly, it is an object of the present invention to provide a follower capable of preventing the generation of a hit sound without causing excessive abrasion on the follower itself, as well as a cam surface of a three-dimensional cam, while providing the wide portion in the follower for preventing the axial movement.

To achieve the above object, the present invention provides a rocking follower mechanism for a three-dimensional cam. A guide groove is formed on a valve lifter of an internal combustion engine having a wide groove on at least a portion thereof. A rocking follower is supported in the guide groove. The rocking follower has a cam sliding surface that is brought into contact with a cam surface of the three-dimensional cam. The three-dimensional cam has different profiles in the axial direction such that a positional variation of the cam surface, in accordance with the rotation of the internal combustion engine, is transmitted to the valve lifter. The rocking follower includes a wide portion corresponding to the expanded width groove of the guide groove for accommodating the wide portion. As a result, the rocking follower is prevented from moving in a direction of the rocking axis. A wide portion is formed at a position in the rocking follower so as not to be in contact with the cam surface.

Accordingly, the wide portion of the rocking follower is positioned so as not to be in contact with and slide on the cam surface of the three-dimensional cam. As a result, the cam surface does not abut against the surface or the angular portion of the wide portion. Therefore, excessive abrasion is not generated on the cam surface of the three-dimensional cam and the rocking follower itself. Further, the hit sound as described above can also be prevented.

In accordance with the invention, among surfaces of the wide portion, the surface facing the three-dimensional cam may be formed closer to the valve lifter than the cam sliding surface.

With the structure described above, the surface of the expanded edge portion opposing the three-dimensional cam is formed closer to the valve lifter than the cam sliding surface. As a result, the cam surface of the three-dimensional cam is not brought into contact with the surface of the wide portion. Therefore, this arrangement prevents collision of the cam surface of the three-dimensional cam against the surface of the wide portion or the angular portion defined by the thrust surface thereof.

In addition, among surfaces of the wide portion, a top of the surface facing the three-dimensional cam may be formed as a tilting surface toward the valve lifter.

The top of the surface of the wide portion opposing the three-dimensional cam may be formed as the tilting surface toward the valve lifter. As a result, it is possible to prevent the cam surface of the three-dimensional cam from contacting with the surface of the wide portion. Therefore, collision of the cam surface of the three-dimensional cam against the surface of the wide portion or the angular portion defined by the thrust surface can be avoided.

BRIEF DESCRIPTION OF THE DRAWINGS

These and other aspects and advantages of the invention will become apparent from the following detailed description of exemplary embodiments when taken in conjunction with the accompanying drawings, in which like reference numerals designate like elements and wherein.

DETAILED DESCRIPTION OF PREFERRED EMBODIMENTS

Figure 1:
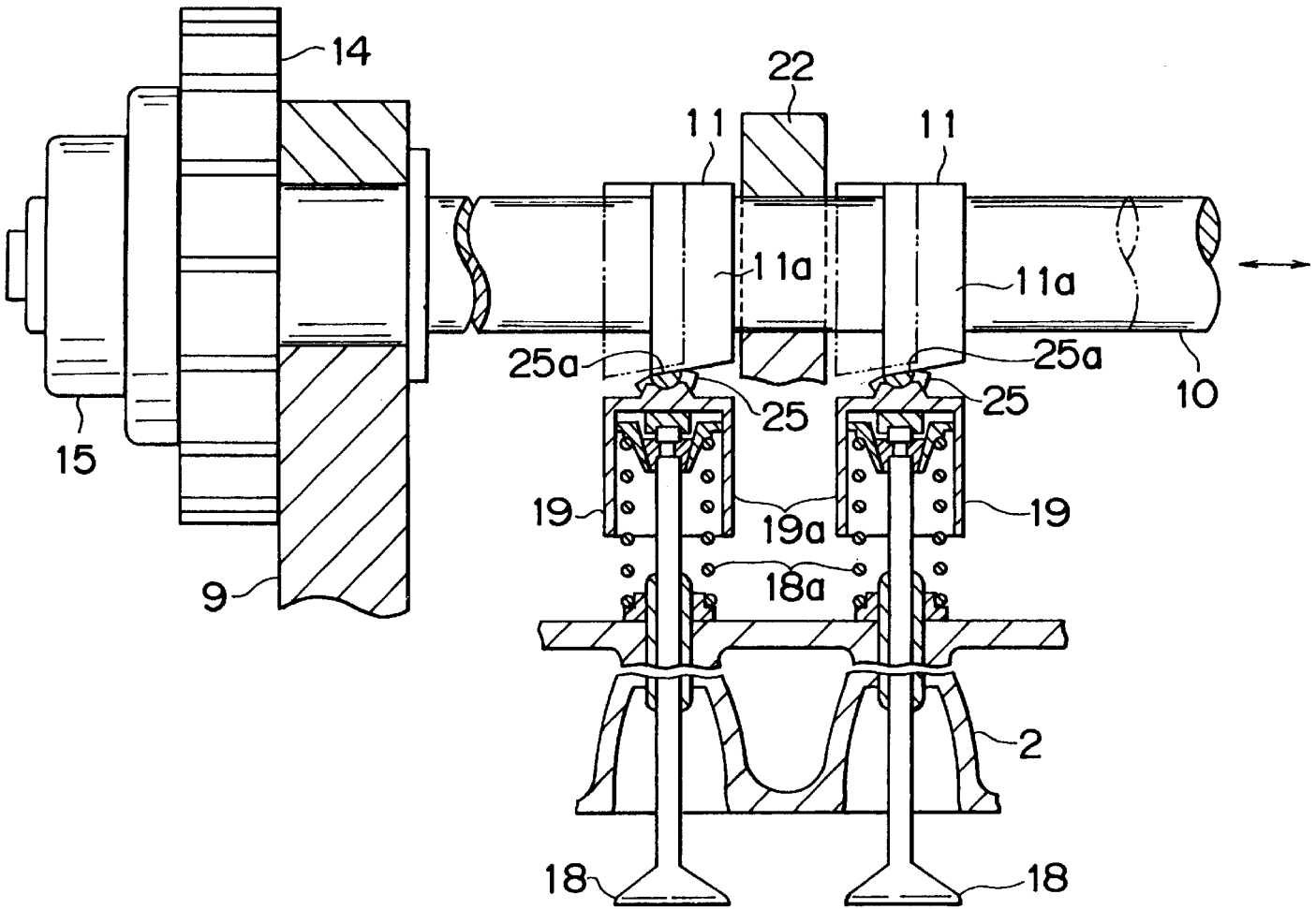
FIG. 1 is a schematic diagram illustrating a valve driving mechanism of a first embodiment in accordance with the invention.

While the invention will hereinafter be described in connection with exemplary embodiments thereof, it will be understood that it is not intended to limit the invention to those embodiments. On the contrary, it is intended to cover all alternatives, modifications and equivalents that may be included within the spirit and scope of the invention.

For a general understanding of the features of the invention, reference is made to the drawings. In the drawings, like reference numerals have been used throughout to designate like elements.

Figure 2:
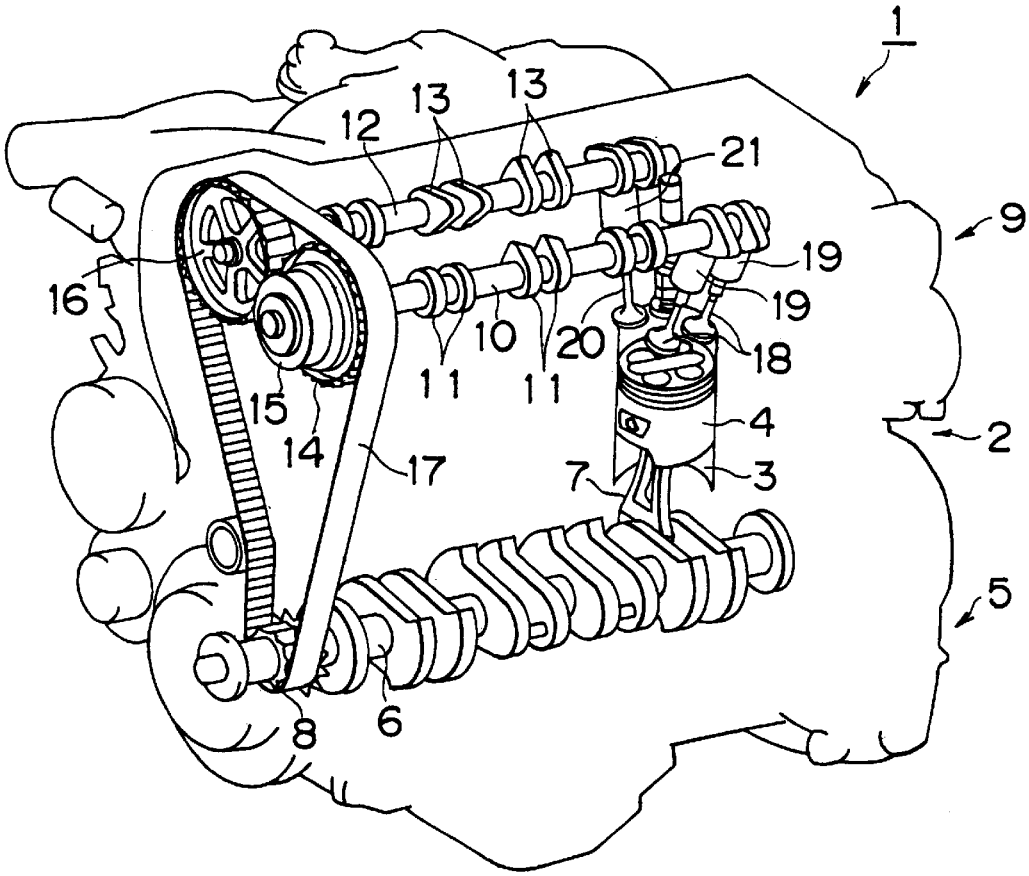
FIG. 2 is a schematic view of a gasoline engine for a vehicle using the valve driving mechanism shown in FIG. 1 in accordance with the invention.

FIG. 1 shows a valve driving mechanism, which is used with a rocking follower mechanism for a three-dimensional cam in accordance with the invention. FIG. 2 shows a schematic diagram of a gasoline engine (hereinafter referred to as the engine) 1 for a vehicle including the arrangement shown in FIG. 1. A DOHC4 valve type is employed as the valve driving type for the engine 1.

A cylinder block 2, in the engine 1, is provided with a plurality of cylinders 3. Each of the cylinders 3 has a piston 4 disposed therein. Each piston 4 is connected, through a connecting rod 7, to a crankshaft 6. The crankshaft 6 is supported by a crankcase 5. A crankshaft timing pulley 8 is provided at one end of the crankshaft 6.

In a cylinder head 9, provided above the cylinder block 2, an intake camshaft 10 is rotatably and axially movable in the lateral direction as shown by the arrow in FIG. 1. The intake camshaft 10 is supported by a plurality of journal bearings 22. The intake camshaft 10 is integrally provided with intake cams 11. That is, two intake cams 11 are associated with each cylinder 3. Further, in the cylinder head 9, an exhaust camshaft 12 is rotatively supported by a plurality of journal bearings so as to be immovable in a direction of the rotation axis. The exhaust camshaft 12 is integrally provided with exhaust cams 13, i.e., two exhaust cams 13 for each cylinder 3.

A camshaft timing pulley 14 and a shaft driving mechanism 15 are integrally provided at one end of the intake cam shaft 10. A camshaft timing pulley 16 is provided at one end of the exhaust camshaft 12. The camshaft timing pulleys 14 and 16 are each connected to the crankshaft timing pulley 8 through a timing belt 17. With such a structure, the intake camshaft 10 and the exhaust camshaft 12 are driven to rotate upon rotation of the crankshaft 6.

In each of the cylinders 3, two intake valves 18 are disposed therein. Each intake valve 18 is driven through a valve lifter 19 to be operatively connected to the intake cam 11. Each valve lifter 19 is slidably supported in a lifter bore (not shown) formed in the cylinder head 9 so as not to rotate therein.

Further, two exhaust valves 20 are disposed in each of the cylinders 3. Each exhaust valve 20 is driven through a valve lifter 21 to be operatively connected to the exhaust cam 13. Each valve lifter 21 is slidably supported in a lifter bore (not shown) formed in the cylinder head 9.

The intake cam 11, supported with the intake camshaft 10, is a three-dimensional cam and includes a cam surface 11*a*. The cam surface 11*a* is formed such that the height of its cam nose is continuously varied in a direction of the rotation axis in a stepless manner. Further, the exhaust cam 13, supported by the exhaust camshaft 12, is a normal cam and the height of its cam nose is not varied in a direction of the rotation axis.

Figure 3:
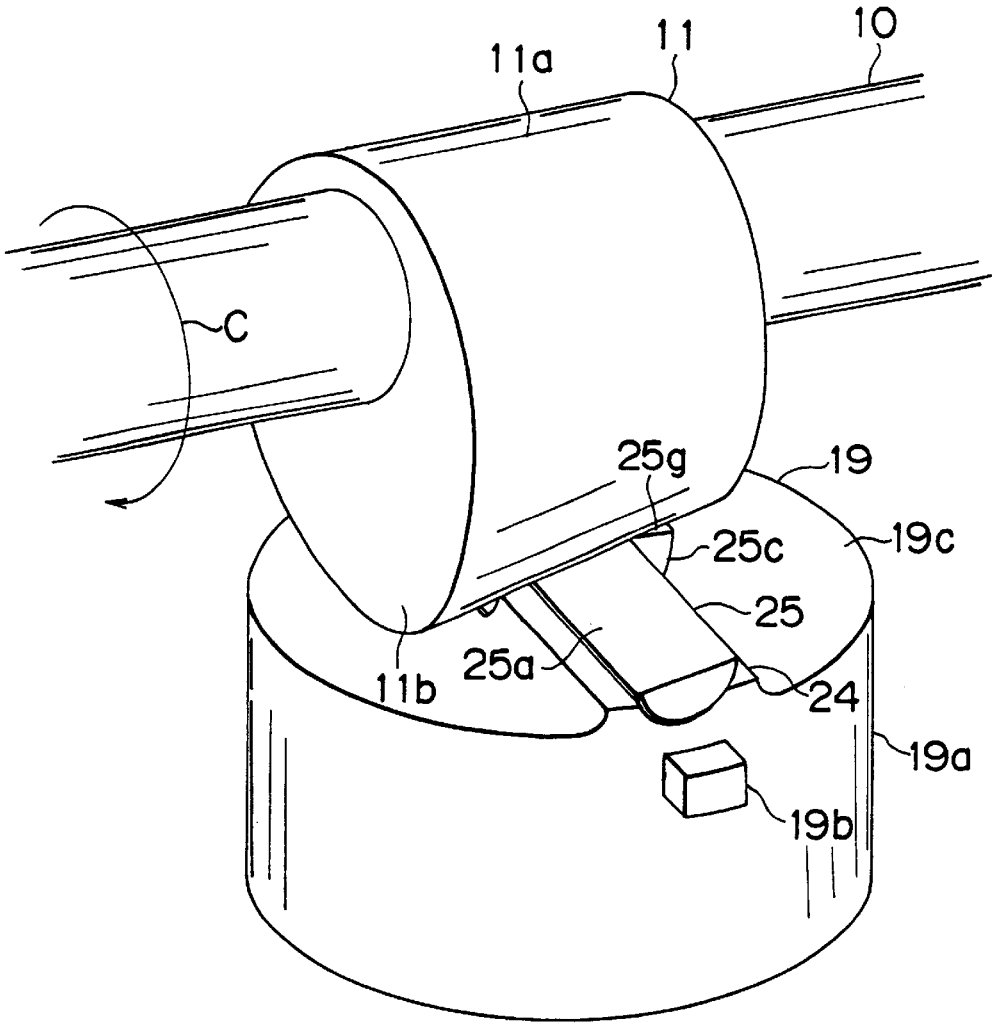
FIG. 3 is a perspective view of a rocking follower mechanism for a three-dimensional cam of the first embodiment in accordance with the invention.

As shown in an enlarged perspective view in FIG. 3, the valve lifter 19 has a cylindrical shape. A guide member 19*b* projects from a side surface 19*a* of the valve lifter 19. The guide member 19*b* is inserted into a guide groove (not shown) formed in an inner peripheral surface of a lifter bore of the cylinder head 9. In such a manner, the valve lifter 19 is slidably guided in a direction of a center axis so as not to rotate in the lifter bore.

A cam follower holder 24 is integrally formed on the upper surface 19*c* of the valve lifter 19. A cam follower 25 (corresponding to a rocking follower) is supported in the cam follower holder 24 so as to be able to rock widthwise. The valve lifter 19 is urged against the intake cam 11 by a spring 18*a* placed under compression between the valve lifter 19 and the cylinder head 9. As a result, a cam sliding surface 25*a* of the cam follower 25 is pressed against the cam surface 11*a* of the intake cam 11. The cam sliding surface 25*a* is allowed to slide in contact with the cam surface 11*a*. The cam follower 25 rocks in accordance with the cam surface 11*a*.

Figure 4:
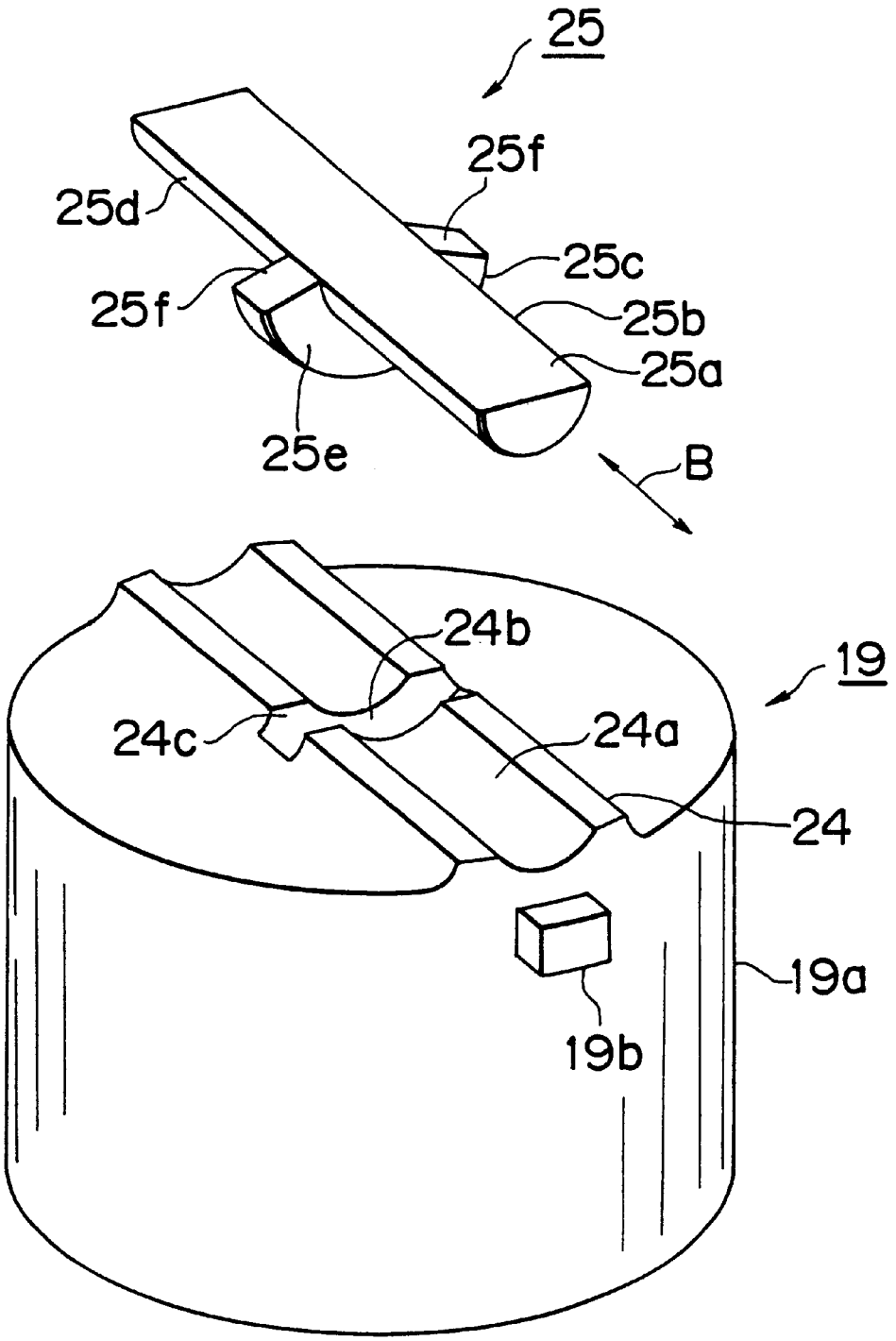
FIG. 4 is an exploded perspective view of the rocking follower mechanism for the three-dimensional cam of the first embodiment in accordance with the invention.
Figure 5A:
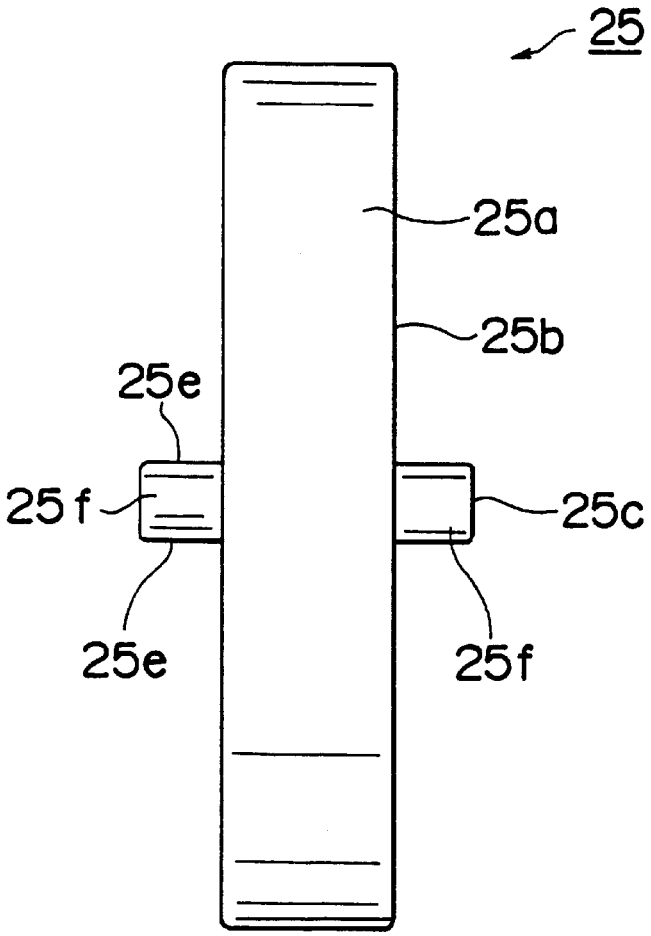
FIGS. 5A and 5B are plane views illustrating a cam follower of the first embodiment accordance with the invention.
Figure 5B:
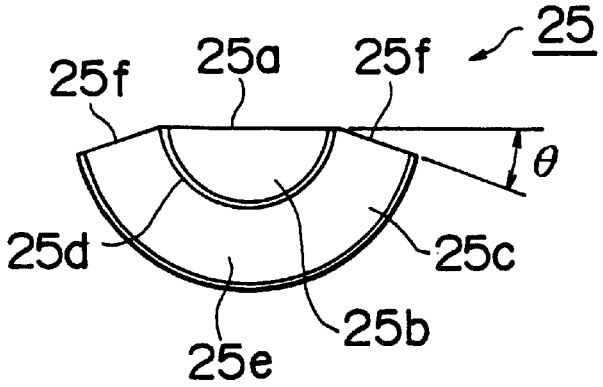
Figure 6:
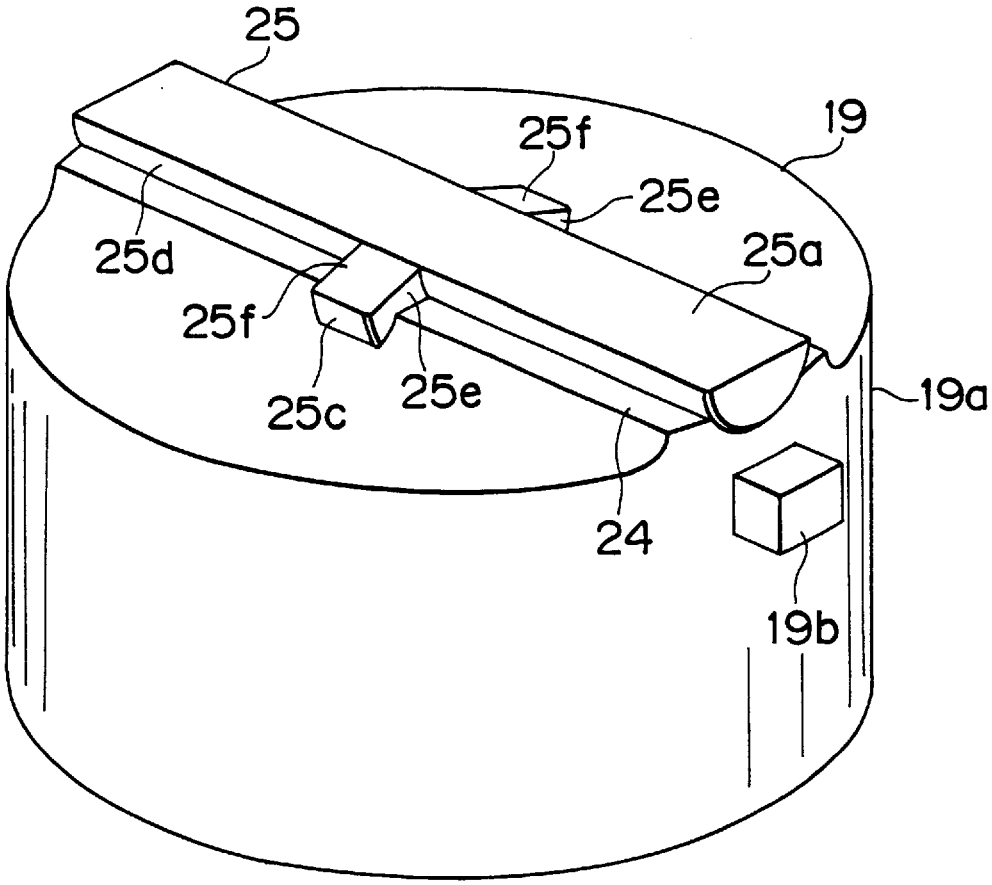
FIG. 6 is a perspective view illustrating an arrangement of a cam follower on the cam follower of the first embodiment in accordance with the invention.
Figure 7:
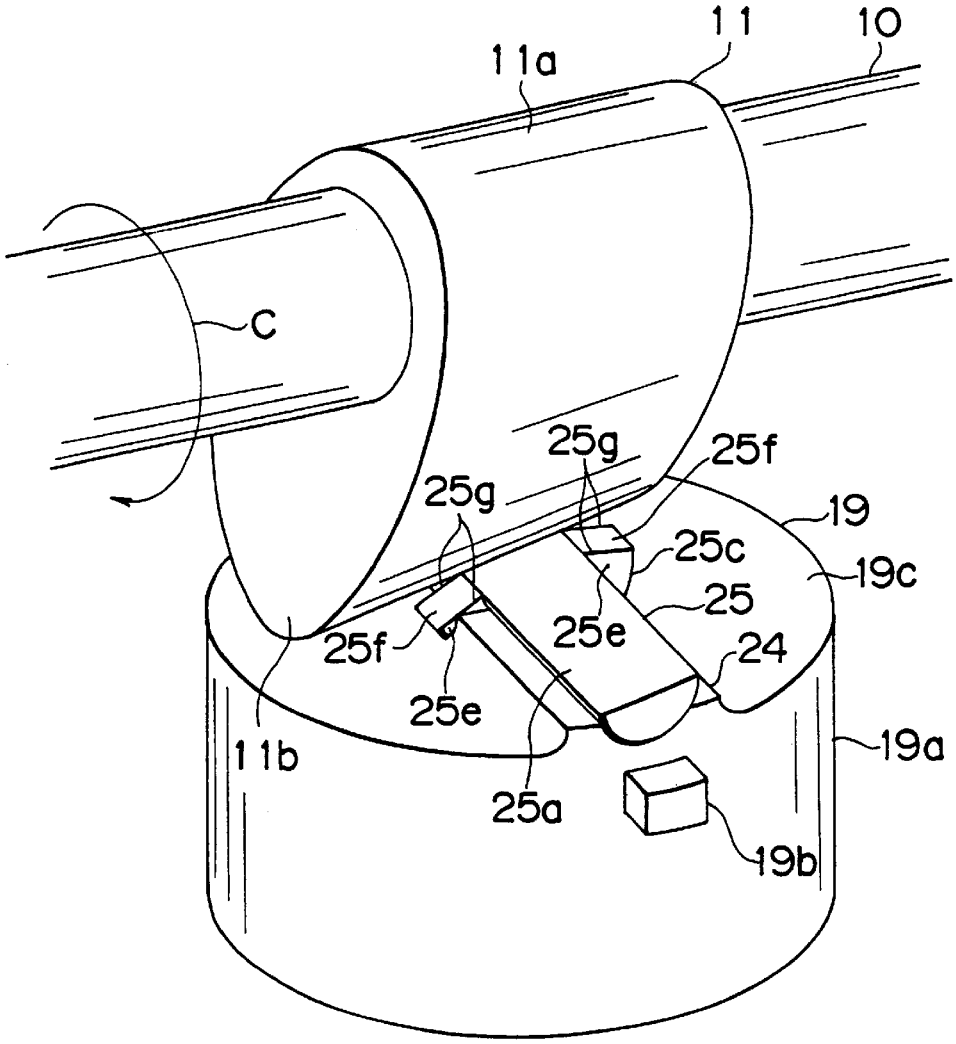
FIGS. 7 and 8 are perspective views illustrating operation of the rocking follower mechanism of the three-dimensional cam of the first embodiment in accordance with the invention.

As shown in an exploded perspective view in FIG. 4, the plan view in FIG. 5A and a front view in FIG. 5B, the cam follower 25 is formed of a semicolumnar body 25*b* and a wide portion 25*c* formed in the center of the body 25*b*. The wide portion 25*c* has a diameter larger than that of the body 25*b*. As shown in FIG. 6, when the body 25*b* is disposed in the cam follower holder 24 of the valve lifter 19 and rocks, an outer peripheral surface of the columnar portion of the body 25 functions as a sliding surface 25*d*. The sliding surface 25*d* slides along the guide groove 24*a* having a semicircle cross section formed in the cam follower holder 24.

The wide portion 25*c* of the cam follower 25 is accommodated in a wide groove 24*b*, as shown in FIG. 4, formed in the center of the guide groove 24*a*. With this structure, a thrust surface 25*e* of the wide portion 25*c* is brought into abutment against a thrust surface 24*c* of the expanded width groove 24*b*. As a result, the cam follower 25 is prevented from moving in the axial direction as shown by the arrow B in FIG. 4. That is, the cam follower 25 disposed in the cam follower holder 24 of the valve lifter 19 can rock around its axis but is not allowed to move along the axial direction.

End surfaces 25*f* of the wide portion 25*c* of the cam follower 25 facing the intake cam 11 form tilt surfaces toward the valve lifter 19. The end surfaces 25*f* are not allowed to reach the cam sliding surface 25*a* as shown in FIG. 5B. The tilt angle is set to the value ranging from $\theta=10°$ to 30°.

With the wide portion 25*c* formed in this manner, the intake camshaft 10 rotates from the position shown in FIG. 3 in the direction of the arrow C. The cam surface 11*a* of the intake cam 11 slides along the cam sliding surface 25*a* of the cam follower 25. As a result, these elements are brought into the positioning shown in FIG. 7. In the course of operation, in accordance with the invention, as shown in FIG. 3 to FIG. 7, the cam surface 11*a* around the cam nose 11*b* of the intake cam 11 slides to move on the center portion of the cam sliding surface 25*a*. The intake cam 11 slides in the axial direction of the cam follower 25, backwards as viewed in FIG. 3, for example.

Figure 8:
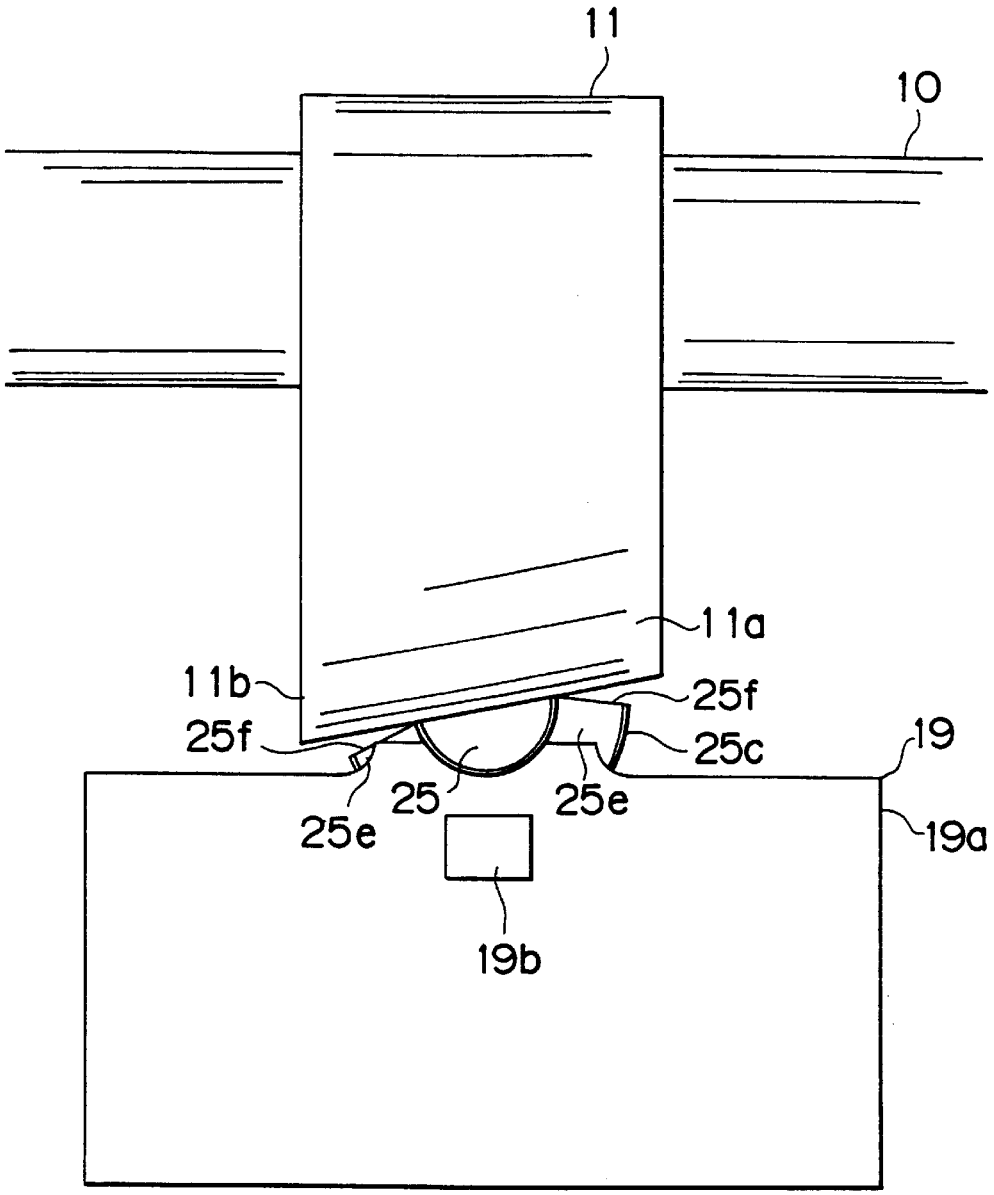

During this sliding movement, the cam surface 11*a* passes by the center of the cam sliding surface 25*a* adjacent to the wide portion 25*c*. Both end surfaces 25*f* of the wide portion 25*c* tilt to recede downward from the cam sliding surface 25*a*. Therefore, even if the cam nose 11*b* slides on the center of the cam sliding surface 25*a* as shown in FIG. 8, the cam surface 11*a* of the intake cam 11 is not brought into contact with the opposing end surfaces 25*f* of the wide portion 25*c* in the course of the sliding movement.

According to the aforementioned embodiment of the invention, the wide portion 25*c* of the cam follower 25 is formed at a position so as not to contact with the cam surface 11*a* of the intake cam 11. Therefore, the cam surface 11*a* of the intake cam 11 does not collide against an angular portion 25*g* defined by the thrust surface 25*e* and the end surface 25*f* of the wide portion 25*c*, and does not directly abut against the end surfaces 25*f*. As a result, excessive abrasion is not generated on the cam surface 11*a* of the intake cam 11 and the cam follower 25 itself, thus preventing generation of the hit sound. As a result, riding comfort of the vehicle can be maintained and noise generation reduced.

Next, a second embodiment of the present invention will be described.

Figure 9A:
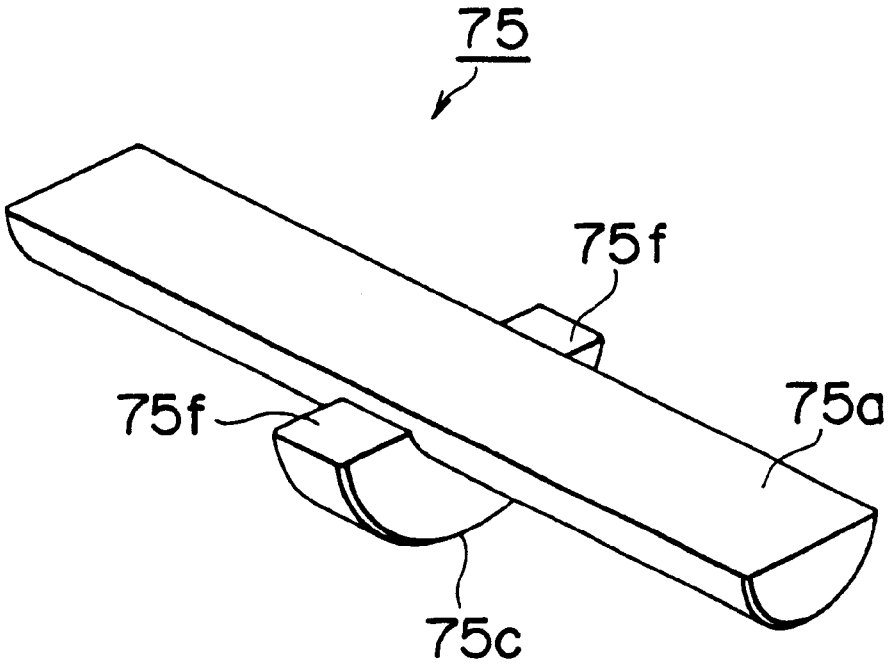
FIGS. 9A and 9B are perspective views showing a cam follower of a second embodiment in accordance with the invention.
Figure 9B:
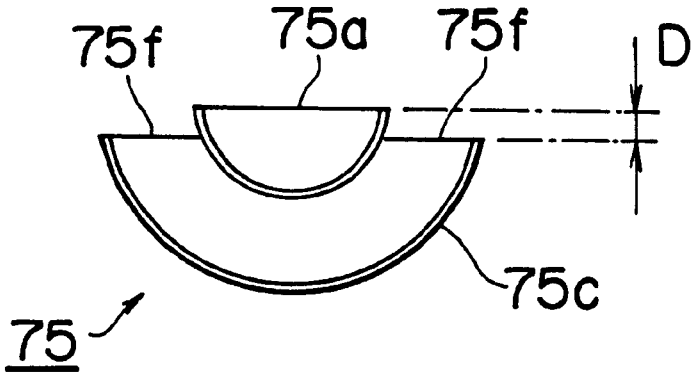
Figure 10:
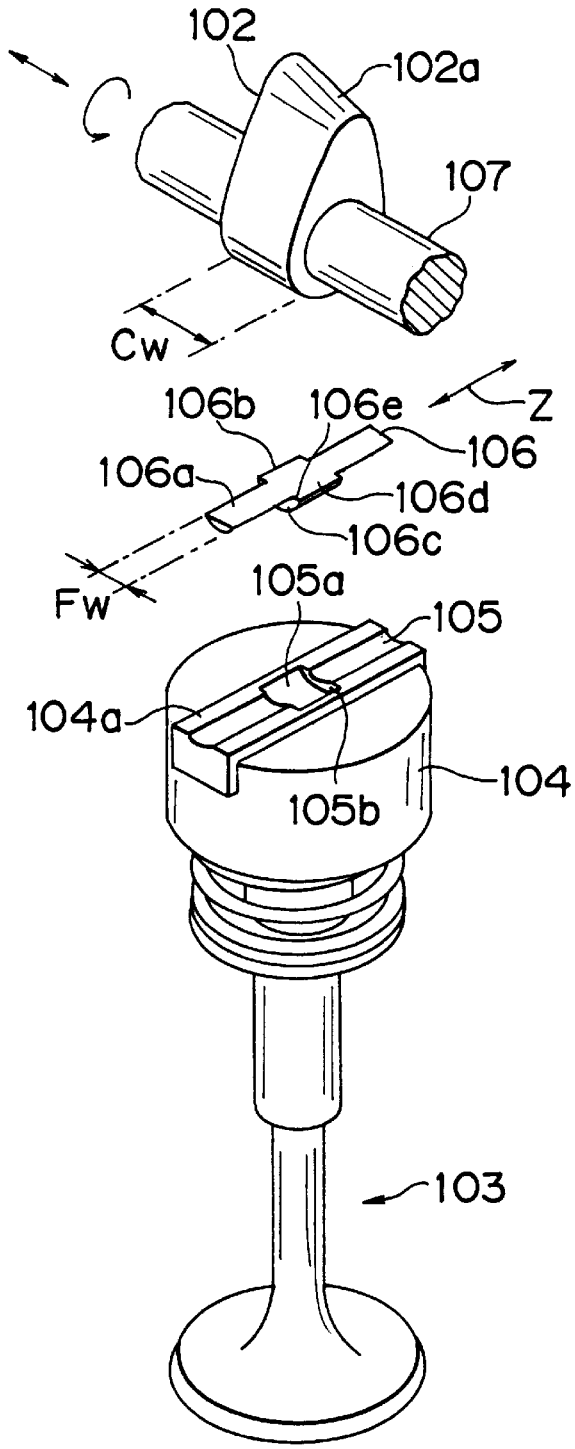
FIG. 10 Related Art
FIG. 10 is an explanatory view illustrating a known rocking follower mechanism of a three-dimensional cam.

FIG. 9A is a perspective view of a cam follower 75 of a valve driving mechanism of the second embodiment. FIG. 9B is a front view thereof The structure of the second embodiment is generally the same as that of the first embodiment. However, the second embodiment is different from the first embodiment in that opposing end surfaces 75*f* of a wide portion 75*c* of a cam follower 75 recede downward from a cam sliding surface 75*a* and in parallel therewith. The height of the resultant stepped portion D, defined by the cam sliding surface 75*a* and the end surface 75*f*, may be specified to, for example, approximately 0.1 mm.

In the first embodiment, since an edge of the end surface 25*f* of the cam follower 25 at the side of the cam sliding surface 25*a* is in contact with the cam sliding surface 25*a*, the cam surface 11*a* of the intake cam 11 might come in slight contact with the angular portion 25*g* around the edge portion of the end surface 25*f* depending upon the pressure of the spring 18*a* urging the valve lifter 19 toward the intake cam 11. However, since the stepped portion D is provided in the second embodiment, there is no such possibility of the contact. Therefore, the riding comfort of the vehicle can be favorably maintained.

Further, the first and second embodiments may be combined such that the opposite end surfaces of the cam follower have both the tilt surface and stepped portion, for example.

In the first and the second embodiments, the intake cam 11 is formed,as the three-dimensional cam and the corresponding valve lifter 19 is provided with the cam follower 25. The exhaust cam 13 may be formed as the three-dimensional cam, and the valve lifter 21 may be provided with the same cam follower. In this case, the shaft driving mechanism similar to the shaft driving mechanism 15 can be provided on the exhaust camshaft 12 so as to be movable in the axial direction.

While the invention has been described in conjunction with specific embodiments thereof, it is evident that many alternatives, modifications and variations may be apparent to those skilled in the art. Accordingly, the exemplary embodiments of the invention as set forth herein are intended to be illustrative, not limiting. Various changes may be made without departing from the spirit and scope of the invention.

What is claimed is:

1. A rocking follower mechanism for operation with a three-dimensional cam in an internal combustion engine, the three-dimensional cam having a cam surface and different profiles in an axial direction thereof, the rocking follower mechanism comprising:

a valve lifter including a surface having a guide groove formed on the surface, the guide groove including an expanded width groove on at least a portion thereof; and a rocking follower supportable in the guide groove and defining a rocking axis, the rocking follower having a cam sliding surface that contacts with the cam surface of the three-dimensional cam such that a positional variation of the cam surface, in accordance with the rotation of the internal combustion engine, is transmitted to the valve lifter;

wherein the rocking follower includes a wide portion corresponding to the expanded width groove of the guide groove, the wide portion operatively engageable with the expanded width groove so as to prevent the rocking follower from moving in a direction of the rocking axis, the wide portion being formed so as not to be operatively contactable with the cam surface.

2. A rocking follower mechanism according to claim 1, wherein the wide portion comprises a wide portion surface facing the three-dimensional cam, the wide portion surface being formed closer to the valve lifter than the cam sliding surface.

3. A rocking follower mechanism according to claim 2, wherein the wide portion surface and cam sliding surface being separated by a stepped portion.

4. A rocking follower mechanism according to claim 1, wherein the wide portion comprises a wide portion surface facing the three-dimensional cam, the wide portion surface being formed as an angled surface extending toward the valve lifter.

5. A rocking follower mechanism according to claim 1, the angled surface angled at about 10–30° relative to the cam sliding surface.

6. A rocking follower mechanism for operation with a cam in an internal combustion engine, the cam having a cam surface, the rocking follower mechanism comprising:

a valve lifter including a surface having a guide groove formed on the surface, the guide groove including an expanded width groove on at least a portion thereof; and a rocking follower supportable in the guide groove and defining a rocking axis, the rocking follower having a cam sliding surface that contacts with the cam surface of the cam such that a positional variation of the cam surface, in accordance with the rotation of the internal combustion engine, is transmitted to the valve lifter;

wherein the rocking follower includes a wide portion corresponding to the expanded width groove of the guide groove, the wide portion operatively engageable with the expanded width groove so as to prevent the rocking follower from moving in a direction of the rocking axis, the wide portion being formed so as not to be operatively contactable with the cam surface.

7. A rocking follower mechanism according to claim 6, wherein the wide portion comprises a wide portion surface facing the cam, the wide portion surface being formed closer to the valve lifter than the cam sliding surface.

8. A rocking follower mechanism according to claim 7, wherein the wide portion surface and cam sliding surface being separated by a stepped portion.

9. A rocking follower mechanism according to claim 6, wherein the wide portion comprises a wide portion surface facing the cam, the wide portion surface being formed as an angled surface extending toward the valve lifter.

10. A rocking follower mechanism according to claim 9, the angled surface angled at about 10–30° relative to the cam sliding surface.

* * * * *